United States Patent [19]

Wischoff

[11] 4,421,267

[45] Dec. 20, 1983

[54] SELF-LOCKING CONTAINER

[75] Inventor: Donald F. Wischoff, Fulton, N.Y.

[73] Assignee: Container Corporation of America, Chicago, Ill.

[21] Appl. No.: 451,807

[22] Filed: Dec. 21, 1982

[51] Int. Cl.[3] ..... B65D 5/66

[52] U.S. Cl. ..... 229/44 R; 206/806

[58] Field of Search ..... 229/44 R, 45 R, 43; 206/806

[56] References Cited

U.S. PATENT DOCUMENTS

| | | | |
|---|---|---|---|
| 3,125,280 | 3/1964 | Henry | 229/44 R |
| 4,230,259 | 10/1980 | Herzog | 206/806 |
| 4,373,660 | 2/1983 | Wytko | 229/44 R |
| 4,381,071 | 4/1983 | Vergiels | 229/44 R |

*Primary Examiner*—Herbert F. Ross

*Attorney, Agent, or Firm*—Richard W. Carpenter; Davis Chin

[57] ABSTRACT

A self-locking paperboard container including opposed pairs of side walls and a locking structure foldably joined to an end of one side wall for holding the container in an assembled and erected condition.

3 Claims, 7 Drawing Figures

SELF-LOCKING CONTAINER

BACKGROUND OF THE INVENTION

1. Field of the Invention

This invention relates generally to paperboard containers, and more particularly to a self-locking container with an internal locking structure that eliminates the need for outside securing means such as glue, staples, or the like to hold the container in assembled condition.

2. Description of the Prior Art

A prior art search in the United States Patent and Trademark Office directed to the subject matter of this application disclosed the following U.S. Pat. Nos.: RE. 29,887; 1,384,115; 1,695,432; 2,125,813; 2,342,551; 2,356,362, 2,358,802; 2,850,160; 3,003,676; 4,230,259.

None of the prior art patents uncovered in the search disclose a collapsible, paperboard container including a locking structure foldably joined to an end of one of the side walls of the container and containing a panel and flaps which are foldable into the container to maintain the container in erected or assembled condition without requiring any outside securing means such as glue, staples, or the like.

SUMMARY OF THE INVENTION

It is an object of the present invention to provide a self-locking paperboard container which can be maintained in assembled or erected condition without outside securing means.

A more specific object of the invention is the provision, in a self-locking container, of a locking structure foldably joined to an end of one of the side walls of the container and which includes a retaining panel and a pair of friction locking flaps adapted to engage inner surfaces of side walls of the container and maintain the container in an erected condition.

These and other objects of the invention will be apparent from examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
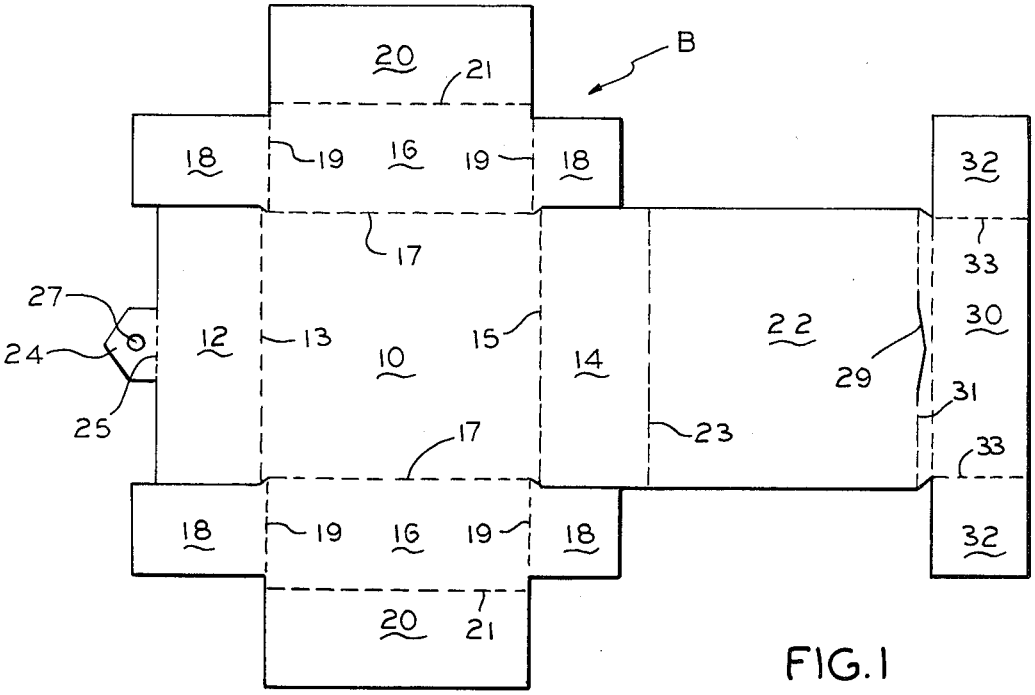
FIG. 1 is a plan view of a blank of foldable sheet material, such as paperboard, from which the container illustrated in the other views may be formed.
Figure 2:
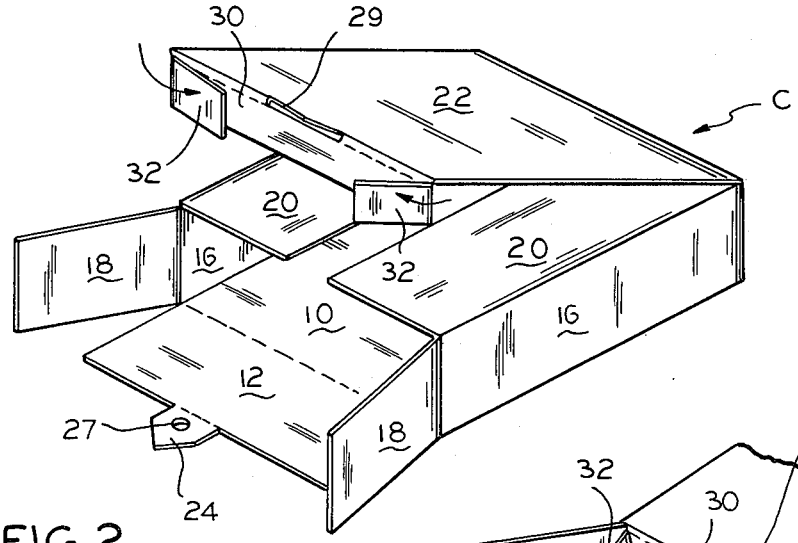
FIGS. 2, 3, and 4 are perspective views illustrating the manner in which the blank of FIG. 1 may be folded and formed into a container embodying features of the invention.

Referring now to the drawings for a better understanding of the invention, and particularly to FIGS. 1 and 2, it will be seen that the container indicated generally C may be formed from a unitary blank B of foldable sheet material, such as paperboard, illustrated in FIG. 1.

The container is a generally tubular structure including opposed major side wall panels 10 and 22 and minor side wall panels 16.

Figure 3:
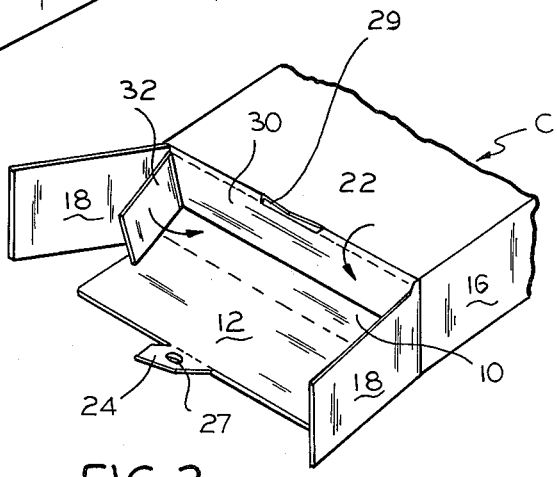
Figure 4:
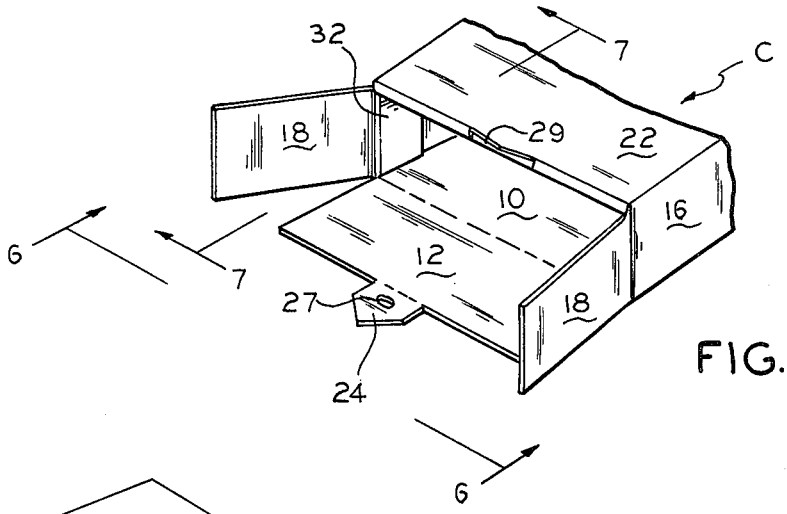

As best seen in FIG. 1, rear major side wall panel 10 has a pair of upper and lower end wall panels 12 and 14 foldably joined to its upper and lower end edges along fold lines 13, and 15, respectively. A pair of minor side wall panels 16 are foldably joined to opposite side edges of rear major side wall panel 10 along fold lines 17. Each of the minor side wall panels 16 has a pair of corner flaps 18 foldably joined to opposite ends thereof along fold lines 19. A pair of front major side wall inner panels 20 are foldably joined along fold lines 21 to other side edges of minor side wall panels 16. A front major side wall outer panel 22 is foldably joined along fold line 23 to a forward edge of bottom end wall panel 14, so that when the container is erected, as shown in FIGS. 2 through 4, the outer panel 22 cooperates with the inner panels 20 to provide a front major side wall for the container which lies parallel to rear major side wall panel 10 and is connected thereto by the minor side wall panels 16.

Foldably joined along a fold line 25 to a forward edge of upper end wall panel 12 is a combination lock/hang tab 24 which may be used to lock the container closed, as hereinafter described and illustrated in FIG. 5. Tab 24 may be provided with an aperture 27 to permit the container to be suspended from a hook or nail for display purposes if so desired.

The novel portion of the container resides in the locking structure joined to front side wall outer panel 22, which structure permits the container to be maintained in an assembled or erected position simply by a friction fit without requiring any outside securing means.

This locking or retaining structure includes a retaining panel 30 foldably joined along fold line 31 to an upper end edge of panel 22. If desired the fold line 31 may be a double fold line depending upon the thickness of the material used to form the container. A pair of friction lock flaps 32 are foldably joined along fold lines 33 to opposite ends of retaining panel 30.

When the carton is erected, the lock or friction flaps 30 are folded 180° so as to lie against the adjacent surface of retaining panel 30 as shown in FIG. 2. After the lock panel 30 has been folded 180° so as to lie against the inner surface of panel 22, as illustrated in FIGS. 3 and 4, the lock flaps 32 can then be folded outwardly 90° so as to lie against the inner surfaces of the upper ends of minor side wall panels 16, as illustrated in FIG. 4. This maintains the carton in erected condition without requiring any additional securing means such as staples, glue, or the like.

Figure 5:
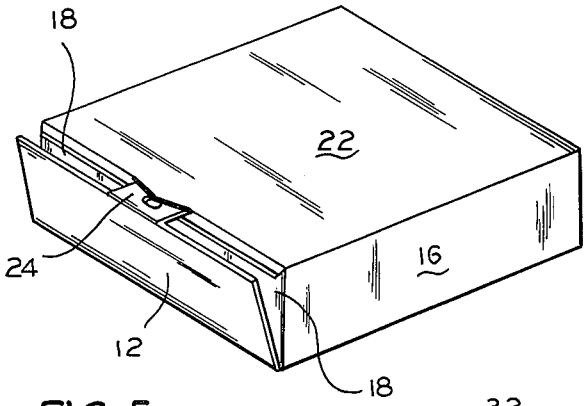
FIG. 5 is a perspective view of a container illustrating the manner in which the tuck tab is used to lock one end of the container in a closed position.
Figure 6:
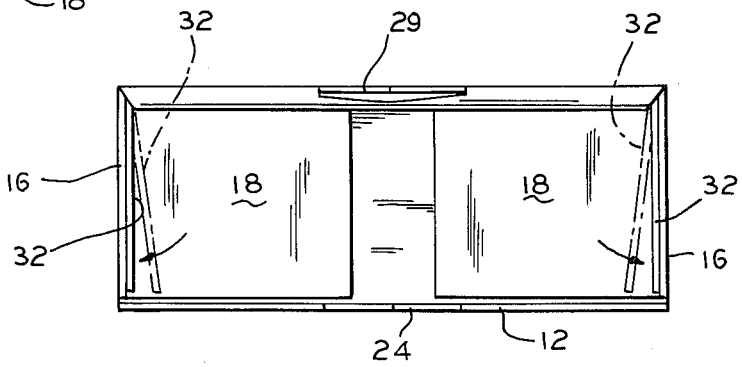
FIG. 6 is a fragmentary end elevational view taken on line 6—6 of FIG. 4.
Figure 7:
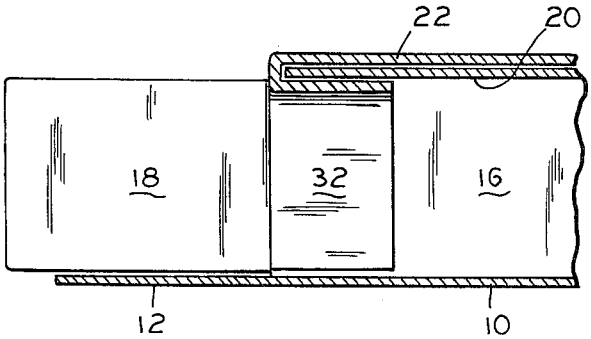
FIG. 7 is a fragmentary sectional view taken on line 7—7 of FIG. 4.

As previously mentioned, tuck or lock tab 24, if desired, may be used to lock the container in a closed position, as shown in FIG. 5, by the insertion of the tab in an opening 29 located at the juncture of the front major side wall panel 22 and retaining panel 30.

Thus, it will be understood that the invention provides a simple but unique means for maintaining a carton or container in an erected position without the use of external securing means.

What is claimed is:

1. A self locking container formed from a unitary blank of foldable sheet material, such as paperboard, comprising:

(a) pairs of opposed major and minor side wall panels foldably joined to each other to form a tubular body open at the ends;

(b) top and bottom end closure flaps joined to end edges of said side wall panels for closing the ends of said tubular body;

(c) an integral locking structure for maintaining said container in assembled, erected condition without requiring outside securing means, said locking structure including:

(i) a retaining panel foldably joined at one edge to an upper end edge of one of said major side wall panels and folded 180° to lie in face-to-face relation with an inner surface of said one major side wall panel;

(ii) a pair of friction-lock flaps foldably joined to opposite end edges of said retaining panel and folded 90° to lie in face-to-face relation with adjacent inner surfaces of respective minor side wall panels.

2. A container according to claim 1, wherein said top closure flaps include:

(i) a pair of inner flaps foldably joined to upper end edges of respective minor side wall panels;

(ii) an outer closure flap foldably joined to an upper end edge of the other of said major side wall panels;

(iii) a tuck tab foldably joined to said outer closure flap at an edge opposite from said other major side wall panel and adapted to be received with an opening in said one major side wall panel at the junction of said one major side wall panel and said retaining panel.

3. A container according to claim 2, wherein said tuck tab includes an aperture receiving a hook or nail to suspend said container therefrom.

* * * * *